US010578995B2

(12) United States Patent
Okumura

(10) Patent No.: US 10,578,995 B2
(45) Date of Patent: Mar. 3, 2020

(54) IMAGE FORMING APPARATUS

(71) Applicant: CANON KABUSHIKI KAISHA, Tokyo (JP)

(72) Inventor: Shohei Okumura, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/411,453

(22) Filed: May 14, 2019

(65) Prior Publication Data

US 2019/0265615 A1 Aug. 29, 2019

Related U.S. Application Data

(63) Continuation of application No. PCT/JP2017/043378, filed on Nov. 27, 2017.

(30) Foreign Application Priority Data

Nov. 28, 2016 (JP) ..... 2016-230500

(51) Int. Cl.
*G03G 15/16* (2006.01)

(52) U.S. Cl.
CPC ..... *G03G 15/1605* (2013.01)

(58) Field of Classification Search
CPC ..... G03G 15/1605; G03G 2215/0658
See application file for complete search history.

(56) References Cited

U.S. PATENT DOCUMENTS 4,556,309 A * 12/1985 Weber ..... G03G 15/0168 399/166
5,150,161 A * 9/1992 Bujese ..... G03G 15/0131 399/251
5,537,194 A * 7/1996 Henry ..... G03G 15/162 399/237
5,570,173 A * 10/1996 Nye ..... G03G 15/0131 399/237
6,466,756 B1 * 10/2002 Nakashima ..... G03G 15/161 399/237

(Continued)

FOREIGN PATENT DOCUMENTS

JP 2001-109274 A 4/2001
JP 2003-091161 A 3/2003

(Continued)

OTHER PUBLICATIONS

PCT International Search Report and Written Opinion dated Feb. 14, 2018, in PCT/JP2017/043378.

*Primary Examiner* — David J Bolduc
(74) *Attorney, Agent, or Firm* — Venable LLP

(57) ABSTRACT

An image forming apparatus can adjust a liquid amount of a carrier liquid layer formed on an intermediary transfer belt depending on an image forming mode.
In a case of a full-color mode, a controller sets an operation mode of a liquid amount adjusting device at a "removal mode" . In a case of a monochromatic mode, the controller sets the operation mode at a "supply mode". In the removal mode, a carrier liquid in the carrier liquid tank is not carried on a feeding roller, so that the carrier liquid is removed from the belt by the feeding roller. In the supply mode, the carrier liquid drawn up from the carrier liquid tank by a supplying roller is supplied to the belt via the feeding roller

5 Claims, 6 Drawing Sheets

(56) References Cited

U.S. PATENT DOCUMENTS 6,496,676 B1 * 12/2002 Caruthers, Jr. ..... G03G 15/161 399/237
7,379,691 B2 * 5/2008 Lee ..... G03G 15/11 399/101
7,697,877 B2 * 4/2010 Asakura ..... G03G 15/2025 399/307
2001/0043825 A1 * 11/2001 Kim ..... G03G 15/1605 399/307
2002/0106220 A1 * 8/2002 Nakashima ..... G03G 15/161 399/237
2002/0131794 A1 * 9/2002 Nukada ..... G03G 15/11 399/249
2003/0059234 A1 * 3/2003 Sasaki ..... G03G 15/065 399/237
2004/0052549 A1 3/2004 Baker et al.
2005/0078984 A1 4/2005 Fujita et al.
2007/0047985 A1 * 3/2007 Kamijo ..... G03G 15/105 399/45
2007/0140739 A1 * 6/2007 Aruga ..... G03G 15/095 399/249
2012/0093544 A1 * 4/2012 Sandler ..... G03G 15/10 399/297
2017/0351202 A1 * 12/2017 Okumura ..... G03G 15/1665
2017/0364012 A1 * 12/2017 Okumura ..... G03G 15/10
2018/0059581 A1 * 3/2018 Torikata ..... G03G 9/12

FOREIGN PATENT DOCUMENTS

JP 2005-099420 A 4/2005
JP 2007-171436 A 7/2007
JP 2008-191298 A 8/2008
JP 2010-066452 A 3/2010
JP 2010-185984 A 8/2010
JP 2011-232518 A 11/2011
JP 2013-033095 A 2/2013

* cited by examiner

IMAGE FORMING APPARATUS

This application is a continuation of PCT Application No. PCT/JP2017/043378, filed on Nov. 27, 2017.

TECHNICAL FIELD

The present invention relates to an electrophotographic image forming apparatus for forming an image with a liquid developer.

BACKGROUND ART

Conventionally, the image forming apparatus in which an electrostatic latent image formed on a photosensitive drum is developed into a toner image by using a liquid developer containing a toner and a carrier liquid, and the toner image developed from the electrostatic latent image is primary-transferred onto an intermediary transfer member and further, the toner image transferred on the intermediary transfer member is secondary-transferred onto a recording material has been known. In such an image forming apparatus, a liquid layer of the carrier liquid is formed on the photosensitive drum or the intermediary transfer member, so that the toner image is capable of being developed and transferred.

However, in the case of an excessive carrier in which a liquid amount of the carrier liquid, i.e., a carrier liquid layer is more than a proper amount, improper fixing is liable to occur when the toner image is fixed on the recording material. Therefore, conventionally, an image forming apparatus in which an excessive carrier liquid is removed from the carrier liquid layer has been proposed (Japanese Laid-Open Patent Application (JP-A) 2003-91161). In the apparatus described in JP-A 2003-91161, the excessive carrier liquid is removed from the carrier liquid layer by a sweep roller rotating in contact with the photosensitive drum. However, in this case, when a shortage of the carrier such that the liquid amount of the carrier liquid layer is less than the proper amount occurs, improper transfer occurs due to the shortage of the carrier during transfer of the toner image, and therefore, the liquid amount of the carrier liquid layer after the removal is adjusted to the proper amount.

Further, although an image forming apparatus uses a dry developer, not the liquid developer, an image forming apparatus of a tandem type and an intermediary transfer type in which a plurality of photosensitive drums are juxtaposed in a movement direction of an intermediary transfer belt has been conventionally proposed (JP-A 2010-66452). In this image forming apparatus, as an image forming mode, for example, a full-color mode in which images are formed with toners of yellow, magenta, cyan and black and a monochromatic mode in which an image is formed with only toner of black are selectively executable. Further, during full-color mode, all the photosensitive drums are contacted to an intermediary transfer belt (hereinafter, simply referred also to as a belt), and during monochromatic mode, only the photosensitive drum for black is contacted to the belt.

Problem to be Solved by the Invention

Recently, also in the image forming apparatus using the liquid developer, in order to realize further downsizing, there is a demand for constituting the image forming apparatus of a tandem type as described in JP-A 2010-66452. However, in that case, during full-color mode, all the photosensitive drums are contacted to the belt. For this reason, in the case of the full-color mode, in a primary transfer step, carrier liquids are transferred from the respective image forming portions, so that an excessive carrier (excess of the carrier) of the carrier liquid layer is liable to occur. Therefore, in order to suppress the excessive carrier during full-color mode, when amounts of carriers supplied from the respective image forming portions to the belt are restricted, during monochromatic mode, a shortage of the carrier of the carrier liquid layer occurred in some cases.

The present invention has been accomplished in view of the above-described problem, and an object of the present invention is to provide an image forming apparatus which has a tandem type and an intermediary transfer type using a liquid developer and which is capable of suppressing a shortage of the carrier liquid on the belt during monochromatic mode while suppressing the excessive carrier during full-color mode.

Means for Solving the Problem

An image forming apparatus of the present invention comprises: a first image bearing member; a second image bearing member; a first developing device for developing a latent image, formed on the first image bearing member, with a developer containing toner and a carrier liquid; a second developing device for developing a latent image, formed on the second image bearing member, with a developer containing toner and a carrier liquid; an intermediary transfer member which is provided rotatably and onto which toner images are primary-transferred together with the carrier liquids from the first image bearing member and the second image bearing member; a secondary transfer device for secondary-transferring the toner images, primary-transferred on the intermediary transfer member, onto a recording material; a controller capable of selectively executing a first mode in which the toner images are primary-transferred together with the carrier liquids from the first image bearing member and the second image bearing member onto the intermediary transfer member, and a second mode in which the toner image is primary-transferred together with the carrier liquid from the second image bearing member onto the intermediary transfer member with control of the first developing device so as to prevent the carrier liquid from being supplied from the first developing device to the first image bearing member; and a supplying device provided opposed to the intermediary transfer member on a side downstream of the second image bearing member and upstream of the secondary transfer device with respect to a rotational direction of the intermediary transfer member, and capable of supplying a carrier liquid to the intermediary transfer member at least during execution of the first mode.

EMBODIMENTS FOR CARRYING OUT THE INVENTION

[Image Forming Apparatus]

Figure 1:
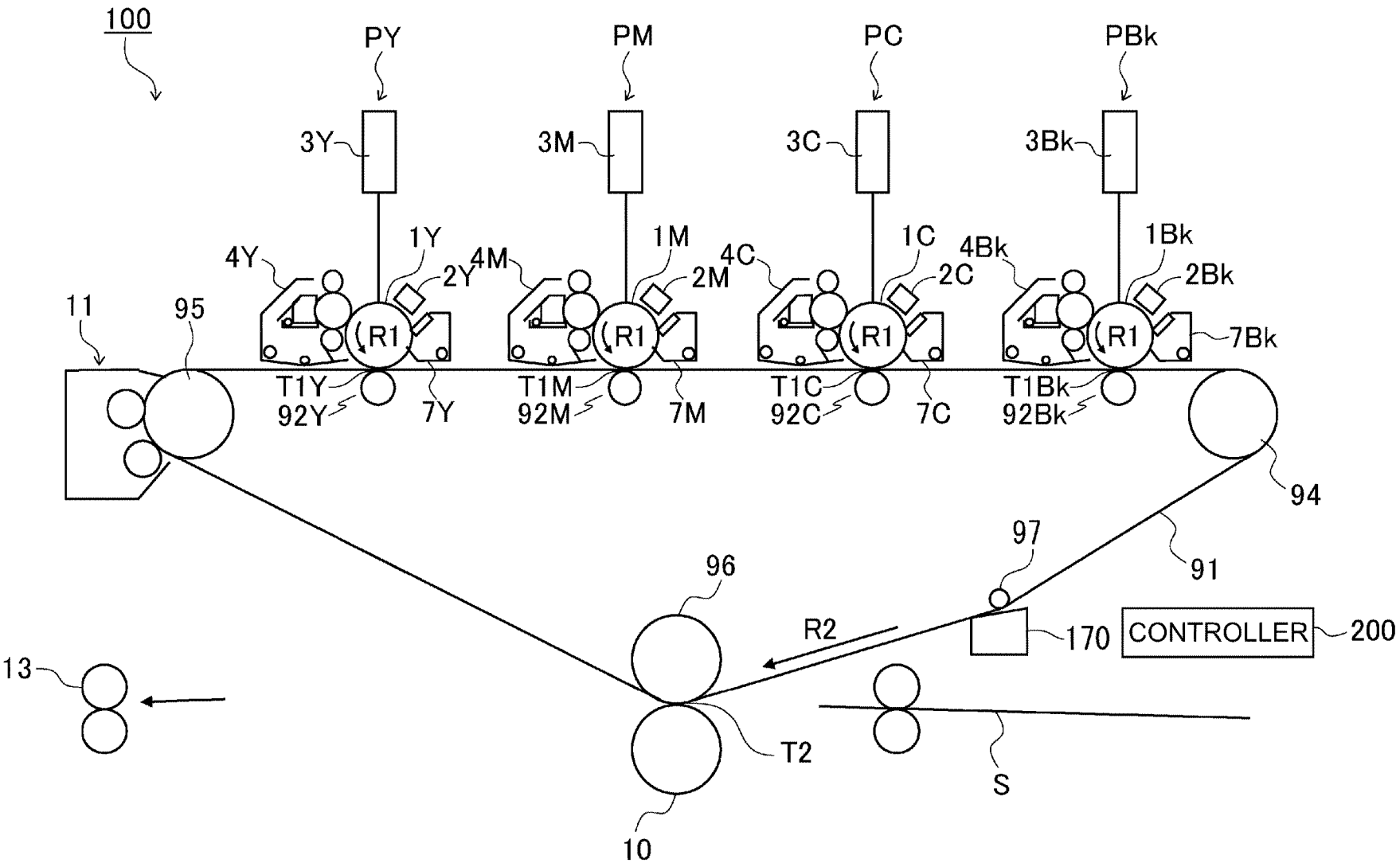
FIG. 1 is a schematic view showing a structure of an image forming apparatus of this embodiment.

A general structure of an image forming apparatus in this embodiment will be described using FIG. 1. An image forming apparatus 100 shown in FIG. 1 is a full-color printer of an intermediary transfer type of a tandem type in which a plurality of image forming portions PY, PM, PC and PBk are arranged. In this embodiment, four image forming portions PY and PBk are disposed in series in a predetermined direction (movement direction) of movement of an intermediary transfer belt 91 as an endless intermediary transfer member in an order of yellow, magenta, cyan and black from an upstream side with respect to the movement direction.

The image forming apparatus 100 is capable of outputting, to a recording material S (for example, a sheet, an OHP sheet and the like), a color image and a monochromatic image which are formed depending on image information from an unshown external host device, such as a personal computer or an image reading device, communicatable with an apparatus main assembly. In the case of this embodiment, two image forming modes including a full-color mode in which color images are capable of being formed using all the image forming portions PY to PBk and a single-color mode in which a single color image is capable of being formed using any one of the image forming portions PY to PBk are executable. In this embodiment, as the single-color mode, a monochromatic mode in which a monochromatic image is formed using only the image forming portion PBk for black.

The image forming apparatus 100 generates an image signal color-separated in accordance with a print signal sent from the external host device and forms toner images of the respective colors by the respective image forming portions PY to PBk depending on this image signal. In the case of the full-color mode as a first mode, the image forming apparatus 100 subjects the respective color toner images formed by the image forming portions PY to PBk to continuous multiple-transfer onto the belt 91, and thereafter subjects the multiple-transferred toner images of plural colors to collective transfer from the belt 91 onto the recording material S. On the other hand, in the case of the monochromatic mode as a second mode, in the image forming apparatus 100, a toner image of a single color of black formed at the image forming portion PBk is transferred onto the belt 91, and thereafter, the toner image of the single color is transferred from the belt 91 onto the recording material S.

The recording material S on which the toner image(s) is (are) transferred is fed to a fixing device 13. The recording material P is fed to the fixing device 13 and is subjected to heating and pressing or to ultraviolet irradiation, whereby the toner image(s) is (are) fixed on the recording material S. The recording material S on which the toner image(s) is (are) fixed by the fixing device 13 is discharged to an outside the image forming apparatus. Thus, the color image or the monochromatic image is outputted onto the recording material S.

[Image Forming Portion]

As described above, the image forming portions PY to PBk for forming the images of the respective colors of yellow (Y), magenta (M), cyan (C) and black (Bk) will be described using FIG. 2. However, the image forming portions PY to PBk are constituted so as to be the same except that colors of toners used in developing devices 4Y to 4Bk are different from each other, and therefore in the case where there is no need to particularly differentiate the image forming portions, description will be made by emitting suffixes Y, M, C and Bk of symbols added for differentiating the image forming portions PY to PBk.

Figure 2:
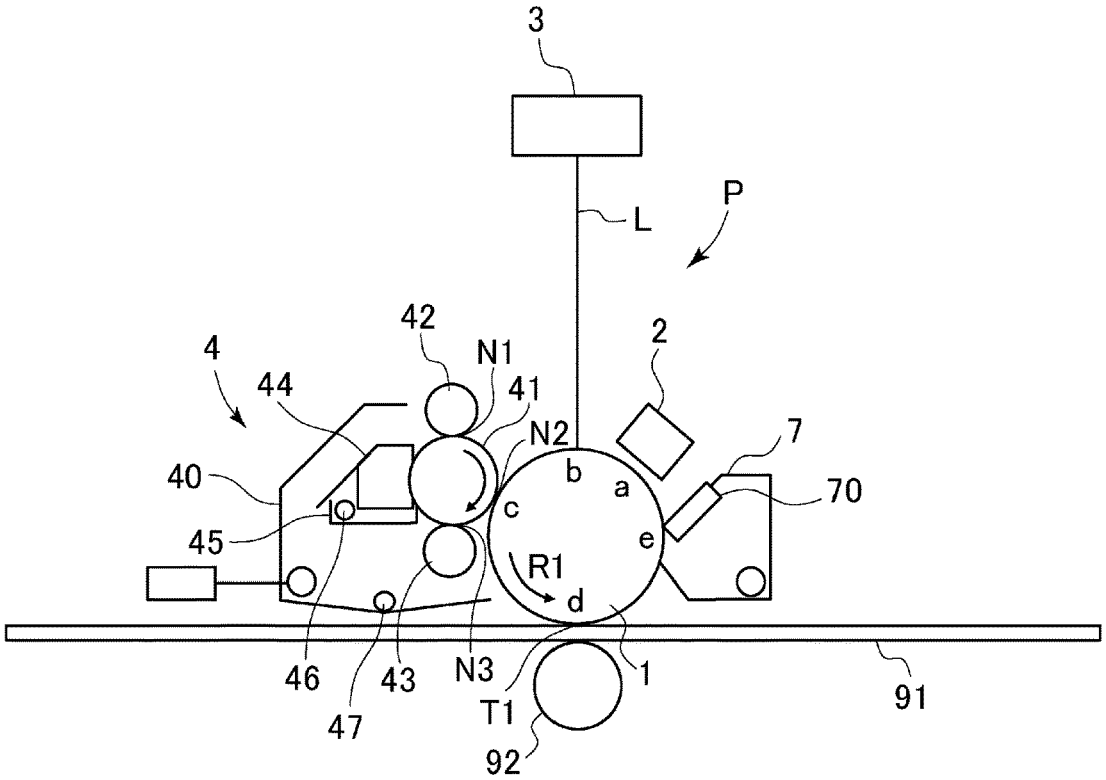
FIG. 2 is a sectional view showing a structure of an image forming portion.

As shown in FIG. 2, at the image forming portion P, a charging device 2, an exposure device 3, the developing device 4 and a drum cleaning device 7 are provided so as to encircle a photosensitive drum 1. The photosensitive drum 1 as a first image bearing member or a second image bearing member is a photoconductor drum in which an amorphous silicon photosensitive layer is formed on an outer peripheral surface of an electroconductive cylinder made of aluminum. The photosensitive drum 1 is rotated in an arrow R1 direction in the figure at a predetermined process speed by an unshown driving motor. The charging device 2 as a charging means is, for example, a corona charger of scorotron type and electrically charges the surface of the photosensitive drum 1 to a uniform negative (−polarity) dark portion potential. The exposure device 3 generates laser light L, from a laser light emitting element, obtained by subjecting scanning line image data developed from separated color image of each of the colors to ON-OFF modulation and writes an electrostatic latent image for an image on the surface of the charged photosensitive drum 1 by scanning with a rotating mirror.

[Liquid Developer]

Then, the electrostatic latent image formed on the photosensitive drum 1 is developed by a liquid developer with the developing device 4. In the developing device 4, the liquid developer in which particulate toner which is a dispersoid is dispersed in a carrier liquid which is a dispersion medium is accommodated, and the developing device 4 develops the electrostatic latent image with the liquid developer. The toner is toner made of a resin material, in which a colorant and a binder are main components, and a charge-assisting agent or the like is added. The toner is formed in, for example, 0.1-2 μm in average particle size. On the other hand, the carrier liquid is a non-volatile liquid having a high resistance and low dielectric constant, and is adjusted so as to be, for example, 1E×9 Ω·cm or more in volume resistivity, 10 or less in relative dielectric constant, and 0.1-100 cP in viscosity. As the carrier liquid, a carrier liquid prepared by using, as a main component, an insulative solvent such as silicone oil, mineral oil, Isopar M (registered trademark, manufactured by Exxon Mobil Corp.) and by adding a charge control agent or the like into the insulative solvent, as needed is usable. Further, a liquid monomer curable with ultraviolet radiation or the like can also be used with a range of the above-described physical properties. In this embodiment, the liquid developer in which a weight percentage concentration of the toner in the liquid developer was adjusted to 1-15% was used.

[Developing Device]

A constitution and a developing operation will be described. As shown in FIG. 2, the developing device 4 includes a developer container 40 forming a casing, a developing roller 41, a squeeze roller 42, a cleaning roller 43, an electrode segment 44, a supplying tray 45, a removing member 30 and the like.

In the developer container 40, a liquid developer containing single color toner and a carrier liquid is accommodated. The developing container 40 opens at a part thereof opposing the photosensitive drum 1 as shown in FIG. 2, so that at this opening, the developing roller 41 is rotatably provided so as to expose at a part thereof. The developing roller 41 is formed in a cylindrical shape and is rotated in the same direction as the photosensitive drum 1 at an opposing surface to the photosensitive drum 1. On a side opposite from the opposing surface of the developing roller 41 to the photosensitive drum 1, the electrode segment 44 is disposed opposed to the developing roller 41 with a gap which is a predetermined interval (for example, 0.5 mm) between the electrode segment 44 and the photosensitive drum 1. Below the electrode segment 44, the supplying tray 45 is disposed, and the liquid developer is drawn up into the above-described gap from the supplying tray 45 by rotation of the developing roller 41. The supplying tray 45 temporarily stores the liquid developer supplied from an unshown mixer so that the developing roller 41 can draw up the liquid developer by rotation thereof.

The electrode segment 44 forms an electric field between itself and the developing roller 44 under application of a voltage by an unshown voltage source. In accordance with this electric field, the toner contained in the liquid developer drawn up into the above-described gap shifts toward a surface side of the developing roller 41. On a side downstream of the electrode segment 44 with respect to a rotational direction of the developing roller 41, the squeeze roller 42 is disposed. The squeeze roller 42 forms a nip (portion) N1 in contact with the developing roller 41. Of the liquid developer on the developing roller 41 passed through an opposing region to the electrode segment 44, the liquid developer on the surface of the developing roller 41 passed through the nip N1 is regulated so that a thickness (a height with respect to a radial direction of the developing roller) is substantially uniform. The liquid developer which does not pass through the nip N1 of the squeeze roller 42 flows along an upper surface of the electrode segment 44 and drops on a bottom side of the developer container 40.

The developing device 4 is provided rotatably by a contact and separation means 202. By rotation of the developing device 4, the developing roller 41 is moved between a position where the developing roller 41 is capable of supplying the liquid developer to the photosensitive drum 1 in contact with the photosensitive drum 1 at a predetermined pressure and a position remoter from the photosensitive drum 1 than this suppliable position is. When the liquid developer passed through the nip N1 of the squeeze roller 42 is fed to a developing position c, the electrostatic latent image on the photosensitive drum 1 is developed into a toner image. That is, the carrier liquid of the liquid developer conveyed to the developing position c by the developing roller 41 is conveyed by the developing roller 41 and the photosensitive drum 1, and is divided into a carrier liquid on the developing roller side and a carrier liquid on the photosensitive drum side, and thus a carrier liquid layer is formed on the drum. Further, the toner in the liquid developer fed to the developing position c is selectively deposited through the carrier liquid layer correspondingly to the electrostatic latent image formed on the photosensitive drum 1, by an electric field by the developing voltage. Thus, the electrostatic latent image on the photosensitive drum 1 is developed into the toner image. Incidentally, the developing position c is a developing nip (portion) N2, formed by the developing roller 41 and the photosensitive drum 1.

On a side downstream of the developing nip N2 with respect to the rotational direction of the developing roller 41, the cleaning roller 43 is disposed. The cleaning roller 43 collects the toner contained in the liquid developer remaining on the developing roller 41 after passing through the developing nip N2 by using an electrostatic force, and in addition, collects the carrier liquid remaining on the developing roller 41 under application of pressure at a collecting nip (portion) N3. The toner and the carrier liquid which are collected by the cleaning roller 43 fall on the bottom side of the developer container 40. The toner and the carrier liquid which fall on the bottom side of the developer container 40 mix with the liquid developer which did not pass through the nip N1, and are returned to the unshown mixer. For that purpose, the developer container 40 is provided with a discharge opening (port) 47 communicating with the mixer, and the discharge opening 47 is configured to permit discharge of the developer therefrom.

Returning to description of the image forming portion P, the toner images formed on the photosensitive drum 1 are successively primary-transferred superposedly onto the belt at a primary transfer position d. On an inner peripheral surface side of the belt 91, a primary transfer roller 92 is provided opposed to the photosensitive drum 1 while sandwiching the belt 91 between itself and the photosensitive drum 1. The primary transfer roller 92 is formed of, for example, an electroconductive sponge, and forms a primary transfer nip (portion) T1 between the photosensitive drum 1 and the belt 91 by pressing the belt 91 against the photosensitive drum 1. The primary transfer position d is the primary transfer nip T1. When the primary transfer voltage is applied to the primary transfer roller 92 by an unshown voltage source, the primary transfer of the toner image from the photosensitive drum 1 onto the belt 91 is carried out at the primary transfer position d. Further, the carrier liquid of the carrier liquid layer on the drum surface conveyed to the primary transfer position d is divided into a carrier liquid on the photosensitive drum side and the belt side, and is conveyed to the photosensitive drum 1 and the belt 91, so that the carrier liquid layer is also formed on an outer peripheral surface side, i.e., a surface side of the belt 91. Thus, at the primary transfer position d, the carrier liquid layer is also formed on the belt 91, so that the toner image is capable of being transferred through the carrier liquid layer.

Primary transfer residual toner remaining on the drum surface without being transferred onto the belt 91 at the primary transfer position d is removed by the drum cleaning device 7. The drum cleaning device 7 includes a cleaning blade 70 contacted to the photosensitive drum 1 at a predetermined pressure.

Returning to FIG. 1, the belt 91 is extended around and stretched by a tension roller 94, a driving roller 95 and a secondary transfer inner roller 96, and a follower roller 97 which are provided on an inner peripheral surface side of the belt 91. The tension roller 94 maintains tension of the belt 91 at a substantially constant level under application of a force for pushing out the belt 91 from an inside of the belt 91 by an unshown pressing means. The driving roller 91 moves the belt 91 in an arrow R2 direction in the figure. The secondary transfer inner roller 96 forms a secondary transfer portion T2 in cooperation with a secondary transfer outer roller 10 provided at a position opposing the secondary transfer inner roller 96 while sandwiching the belt 91 therebetween. The follower roller 97 is provided between the tension roller 94 and the secondary transfer inner roller 96 with respect to the movement direction of the belt 91.

The toner images successively primary-transferred superposedly on the belt are secondary-transferred collectively onto the recording material S which has been conveyed to a secondary transfer portion T2. The secondary transfer portion T2 is a toner image transfer nip onto the recording material S, formed by contact of the secondary transfer outer roller 10 as a transfer means with the belt 91 stretched by the secondary transfer inner roller 96. At the secondary transfer portion T2, the toner images are secondary-transferred from the belt 91 onto the recording material S by applying a secondary transfer voltage to the secondary transfer outer roller 10 by an unshown voltage source. Then, secondary transfer residual toner remaining on the belt after the secondary transfer is collected by a belt cleaning device 11.

As the above-described belt 91, a resin belt or a belt in which an elastic layer is formed on a resin base layer can be suitably used.

[Liquid Amount Adjusting Device]

As shown in FIG. 1, the image forming apparatus 100 of this embodiment includes a liquid amount adjusting device 170. The liquid amount adjusting device 170 as an adjusting means is provided at a position opposing the follower roller 97 while sandwiching the belt 91 between itself and the follower roller 97. That is, the liquid amount adjusting device 170 is disposed on an outer peripheral surface side (front surface side) of the belt 91 and on a side downstream of the primary transfer portion T1Bk for black and upstream of the secondary transfer portion T2 with respect to the movement direction (predetermined direction). In the case of this embodiment, the liquid amount adjusting device 170 has a function of supplying the carrier liquid to the belt 91 and a function of removing the carrier liquid from the belt 91, and is capable of adjusting a liquid amount of the carrier liquid on the belt 91. This liquid amount adjusting device 170 will be described using FIG. 3.

Figure 3:
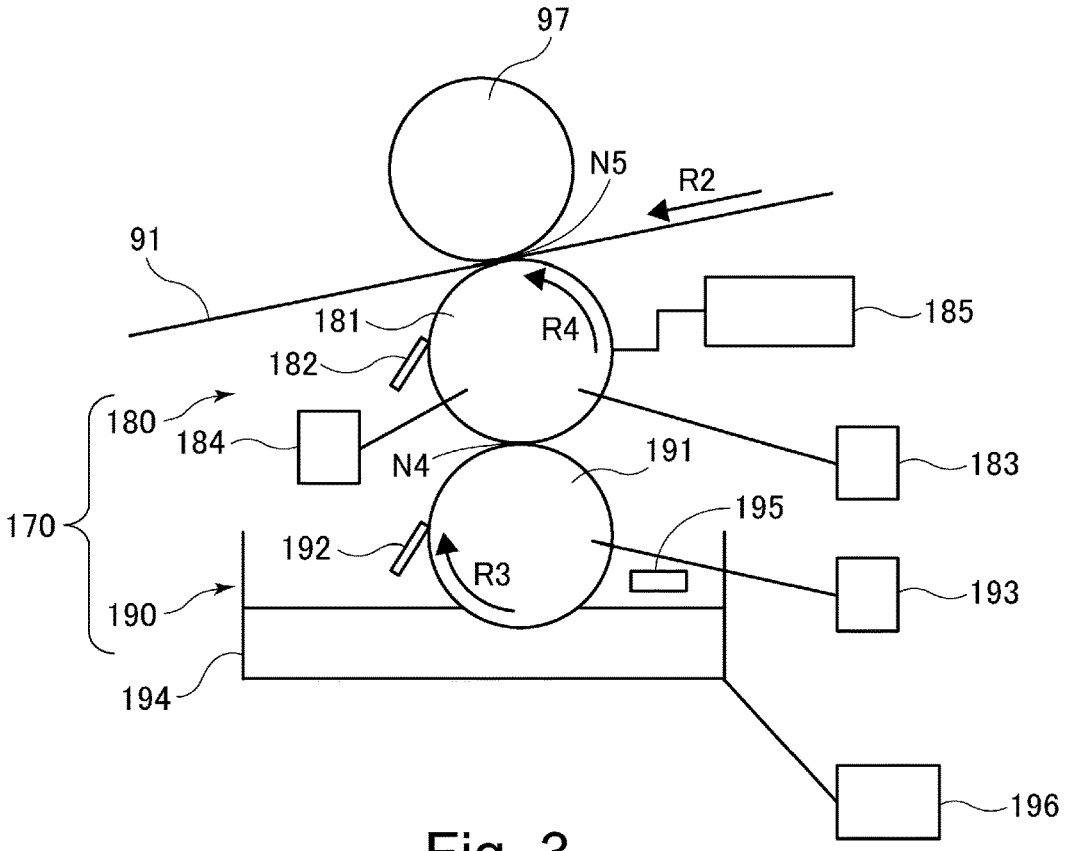
FIG. 3 is a sectional view showing a structure of a liquid amount adjusting device.

As shown in FIG. 3, the liquid amount adjusting device 170 can be roughly divided into a feeding device 180 and a supplying device 190. In the case of this embodiment, the supplying device 190 is provided on a lower side, with respect to a direction of gravitation, which is a side remoter from the belt 91 than the feeding device 180 is. The supplying device 190 includes a supplying roller 191 as a second roller, a regulating blade 192, a supplying roller driving means 193, a carrier liquid tank 194 and a liquid surface (level) sensor 195. In the carrier liquid tank 194, the carrier liquid is accommodated. The carrier liquid tank 194 is connected to an unshown carrier tank, and the carrier liquid is supplied from the carrier tank to the carrier liquid tank 194. The supply of the carrier liquid is carried out on the basis of a detection result of the liquid surface sensor 195 disposed in the carrier liquid tank 194. Specifically, in the case where the carrier liquid is decreased until a liquid surface level detected by the liquid surface sensor 195 reaches a predetermined value or less, the carrier liquid is supplied. As the liquid surface sensor 195, for example, a sensor of an ultrasonic type capable of detecting the liquid surface level by measuring a time from a start of irradiation of ultrasonic wave applied toward the liquid surface until the applied ultrasonic wave is reflected by the liquid surface and is returned to the sensor, or the like sensor is used.

The supplying roller 191 includes a core metal and an elastic layer formed at a periphery thereof. The elastic layer is for example, 1E+8 Ω·cm or less in a volume resistivity, 30-50 degrees in hardness (JIS-A), and 2 μm or less in surface roughness Rz, and is formed with a urethane rubber or the like. The supplying roller 191 is provided rotatably in the carrier liquid tank 194 so that a part of an outer peripheral surface thereof is immersed in the carrier liquid accommodated in the carrier liquid tank 194. The supplying roller 191 is rotated in an arrow R3 direction by the supplying roller driving means 193 such as a motor or the like. The supplying roller 191 is capable of carrying the carrier liquid by rotation thereof. The carrier liquid carried on the supplying roller 191 is regulated by the regulating blade 192 contacted to the supplying roller 191 at a predetermined pressure, whereby a thickness (a level (height) with respect to the radial direction of the supplying roller) of the carrier liquid on the supplying roller 191 is adjusted substantially uniformly. The thickness of the carrier liquid after adjustment is 4-20 μm, for example. Thus, a supply amount per unit time is maintained at a certain amount by the rotating supplying roller 191, and the carrier liquid in the carrier liquid tank 194 is supplied to the feeding device 180.

On the other hand, the feeding device 180 includes a feeding roller 181, a removing blade 182, a feeding roller driving means 183 and a feeding roller application voltage source 184. The feeding roller 181 is, for example, about 0.2-2 μm in surface roughness Rz, and is formed by stainless steel (SUS alloy). The feeding roller 181 is rotated in an arrow R3 direction by the feeding roller during means 183 such as a motor. A rotational direction of the feeding roller 181 coincides with the movement direction (the arrow R2 direction in the figure) of the belt 91 at an opposing surface opposing the belt 91, and coincides with the rotational direction (the arrow R3 direction in the figure) of the supplying roller 191 at an opposing surface opposing the supplying roller 191. The feeding roller 181 is capable of carrying the carrier liquid by rotation thereof.

The removing blade 182 contacts the feeding roller 181 and removes, from the feeding roller 181, the carrier liquid carried on the feeding roller 181. In the case of this embodiment, the removing blade 182 removes the carrier liquid remaining on the feeding roller 181. By removal of the carrier liquid by this removing blade 182, when the carrier liquid is supplied from the supplying roller 191, the thickness (the level with respect to the radial direction of the feeding roller) of the carrier liquid on the feeding roller 181 becomes substantially uniform. A feeding roller application voltage source 184 as a voltage applying means applies, to the feeding roller 181, a voltage of the same polarity (negative in this case) as the toner of the toner image transferred on the belt.

Incidentally, in this embodiment, the thickness of the carrier liquid on the feeding roller 181 is made adjustable substantially uniformly by using the regulating blade 192, but as a regulating means, an anilox roller, a roller pair or the like may also be used in place of the regulating blade 192.

The supplying device 190 is movable by a supplying device contact and separation means 196 between a position where the supplying roller 191 contacts the feeding roller 181 and a position (see FIG. 4 described later) where the supplying roller 191 is separated from the feeding roller 181. That is, the supplying roller 191 interposed between the carrier liquid in the carrier liquid tank 194 and the feeding roller 181 moves between a contact position where the supplying roller 191 contacts both the carrier liquid in the carrier liquid tank 194 and the feeding roller 181 and a separated position where the supplying roller 191 is separated from the feeding roller 181.

On the other hand, the feeding device 180 is movable by a feeding device contact and separation device 185 between a position where the feeding roller 181 contacts the belt 91 and a position (see FIG. 8 described later) where the feeding roller 181 is separated from the belt 91. In this embodiment, by cooperation of these supplying device contact and separation means 196 and feeding device contact and separation means 185, an operation mode (operating mode) of the liquid amount adjusting device 170 is set at either of a supply mode (supplying mode) and a removal mode (removing mode). Here, the operation mode of the liquid amount adjusting device 170 will be described.

The supply mode which is one of the operation mode will be described using FIG. 3. As shown in FIG. 3, in the case where the liquid amount adjusting device 170 operates in the supply mode, the supplying roller 191 forms a nip N4 in contact with the feeding roller 181, and the feeding roller 181 forms a nip N5 in contact with the belt 91. The carrier liquid drawn up from the carrier liquid tank 194 by the supplying roller 191 is supplied from the supplying roller 191 to the feeding roller 181 in the nip N4. In the nip N4, the carrier liquid in an amount which is about half of the amount of the carrier liquid on the feeding roller 181 is moved to the feeding roller side. Therefore, the thickness of the carrier liquid on the feeding roller 181 is 2-10 μm, for example. The feeding roller 181 feeds, toward the nip N5, the carrier liquid supplied form the supplying roller 191. The carrier liquid reaching the nip N5 is divided into a carrier liquid on the belt 91 side and a carrier liquid on the feeding roller 181 side. That is, the carrier liquid is supplied to the belt 91. On the other hand, the carrier liquid divided to the feeding roller 181 side is removed by the removing blade 182 and is collected in the carrier liquid tank 194. Incidentally, to the feeding roller 181, the voltage of the same polarity as the toner is applied by the feeding roller application voltage source 184, so that the toner of the toner image transferred on the belt is not moved from the belt 19 to the feeding roller 181.

Figure 4:
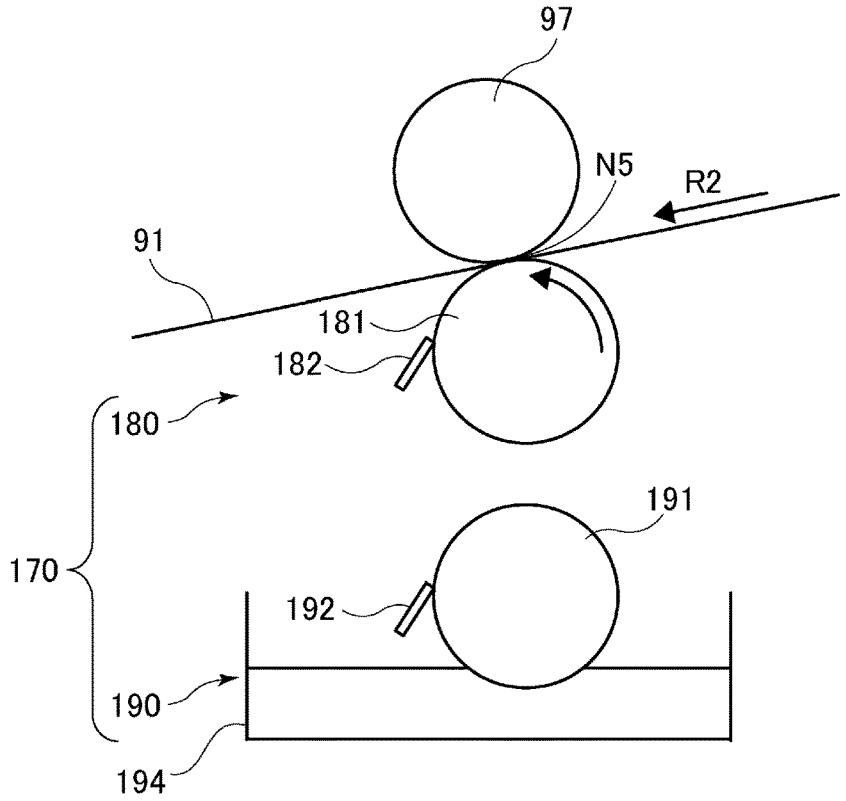
FIG. 4 is a schematic view for illustrating a recording material of the liquid amount adjusting device.

The removal mode which is one of the operation mode will be described using FIG. 4. As shown in FIG. 3, in the case where the liquid amount adjusting device 170 operates in the removal mode, the feeding roller 181 forms the nip N5 in contact with the belt 91, while the supplying roller 191 does not contact the feeding roller 181 and does not form the nip N4 (see FIG. 3). That is, the feeding roller 181 and the supplying roller 191 are separated from each other. For that reason, the carrier liquid drawn up from the carrier liquid tank 194 by the supplying roller 191 is not supplied to the feeding roller 181. Unless the carrier liquid in the carrier liquid tank 194 is supplied to the feeding roller 181, the carrier liquid is not supplied to the belt 91. However, to the feeding roller 181 to which the carrier liquid not supplied, the carrier liquid is supplied from the belt 91 in the nip N5. This is because when the carrier liquid of the carrier liquid layer formed on the belt 91 reaches the nip N5, the carrier liquid is to be divided into a carrier liquid on the belt side and a carrier liquid on the feeding roller side. By this, a part of the carrier liquid of the carrier liquid layer formed on the belt 91 is removed from the belt 91 by the feeding roller 181. Thus, in this embodiment, the carrier liquid in the carrier liquid tank 194 is prevented from being carried by the feeding roller 181, so that the feeding roller 181 is capable of removing the carrier liquid from the belt 91.

Incidentally, the carrier liquid removed from the belt 91 by the feeding roller 181 is removed from the feeding roller 181 by the removing blade 182 and is collected in the carrier liquid tank 194. Further, also in the removal mode similarly as in the supply mode, to the feeding roller 181, the voltage of the same polarity as the toner is applied by the feeding roller application voltage source 184, and therefore, the toner of the toner image transferred on the belt does not move from the belt 91 to the feeding roller 181.

[Controller]

Figure 5:
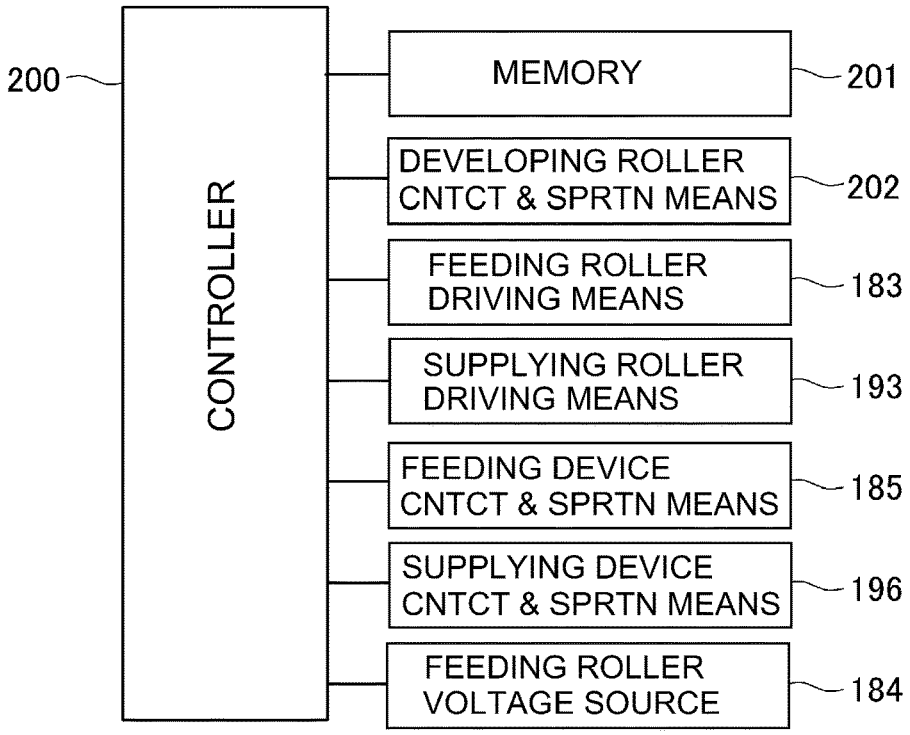
FIG. 5 is a control block diagram showing an operation control system of the liquid amount adjusting device.

As shown in FIG. 1, the image forming apparatus 100 of this embodiment includes a controller 200. The controller 200 will be described using FIG. 5 while making reference to FIGS. 1 and 2. Incidentally, with the controller 200, in addition to the illustrated members, various devices such as motors and voltage sources and the like for operating the image forming apparatus 100 are connected. But, here these members are not the main object of the present invention and therefore are omitted from illustration and description.

The controller 200 as a control means carries out various pieces of control of the image forming apparatus 100, such as an image forming operation, and includes a CPU (Central Processing Unit) omitted from illustration. To the controller 200, a memory 201 as a storing means, such as an ROM, an RAM or a hard disk device is connected. In the memory 201, various programs, data and the like for controlling the image forming apparatus 100 are stored. The controller 200 executes an image forming job stored in the memory 201 and is capable of causing the image forming apparatus 100 to carry out image formation. In the case of this embodiment, the controller 200 adjusts the liquid amount of the carrier liquid layer formed on the belt 91 during execution of the image forming job (i.e., during post-rotation). This liquid amount adjustment of the carrier liquid layer will be described later. Incidentally, in the memory 201, calculation process results with execution of various control programs, and the like are capable of being temporarily stored.

The image forming job is a series of operations from a start of the image formation until the image forming operation is completed, on the basis of a print signal for forming the image on the recording material. That is, the image forming job is a series of operations from a start of a preparatory operation (so-called a pre-rotation operation) required for carrying out the image formation until a preparatory operation (so-called a post-rotation) required for ending the image formation toner the image forming step. Specifically, the image forming job refers to the operations from the time of the pre-rotation (preparatory operation before the image formation) after receiving the print signal (reception of the image forming job) to the post-rotation (operation after the image formation), and includes an image forming period and a sheet interval. Herein, during the pre-rotation is a period from a start of rotations of the photosensitive drums 1Y to 1Bk and the belt 91 and the like without forming the toner images upon receipt of a print signal at the time of a start of image formation until exposure of the photosensitive drums 1Y-1Bk to light is started. During the post-rotation is a period from an end of final image formation of the image forming job until rotations of the photosensitive drums 1Y to 1Bk and the belt 91 and the like which are continuously rotated without forming the toner images are stopped.

To the controller 200, in addition to the memory 201, the charging voltage source 53, a developing roller contact and separation means 202 is connected via an unshown interface. The developing roller contact and separation means 202 is a motor, an operation mechanism and the like for rotating the developing device 4. In response to the rotation of the developing device 4, the developing roller 41 is switched between a state of contacting the photosensitive drum 1 and a state of being separated from the photosensitive drum 1. The developing device 4 is switched to the state of being separated from the photosensitive drum 1 during the post-rotation of the image forming job and is switched to the state of contacting the photosensitive drum 1 during the pre-rotation of the image forming job.

To the controller 200, the feeding roller driving means 183, the supplying roller driving means 193, the feeding device contact and separation means 185, the supplying device contact and separation means 196, the feeding roller application voltage source 184 and the like are further connected. As described above, the feeding roller driving means 183 is the motor or the like for rotating the feeding roller 181. The supplying roller driving means 193 is the motor or the like for rotating the supplying roller 191. The feeding roller 181 and the supplying roller 191 may preferably be rotated at the same peripheral speed as a peripheral speed of the driving roller 95, i.e., a moving speed of the belt 91. The feeding device contact and separation means 185 is the motor, the operation mechanism or the like for moving the feeding device 180 so that the feeding roller 181 moves between the contact position with the belt 91 and the separated position from the belt 91. The supplying device contact and separation means 196 is the motor, the operation mechanism or the like for moving the supplying device 190 so that the supplying roller 191 moves between the contact position with the feeding roller 181 and the separated position from the feeding roller 181. The feeding roller application voltage source 184 is a voltage source for applying the voltage of the same polarity as the toner to the feeding roller 181.

Incidentally, during execution of the image forming job, the above-described controller 200 carries out various settings at the time of operating the image forming apparatus 100, on the basis of print setting information included in the print signal received from the unshown external host device. The print setting information includes pieces of information such as designation of the image forming mode, a kind and a size of the recording material S, and designation of unshown sheet feeding cassettes for accommodating the recording materials S. In the case of this embodiment, on the basis of the designation of the image forming mode of the information, the controller 200 is capable of setting the operation mode of the liquid amount adjusting device 170. Specifically, the supply mode (see FIG. 3) is set during monochromatic mode (during a second mode), and the removal mode (see FIG. 4) is set during full-color mode (during a first mode).

Figure 6:
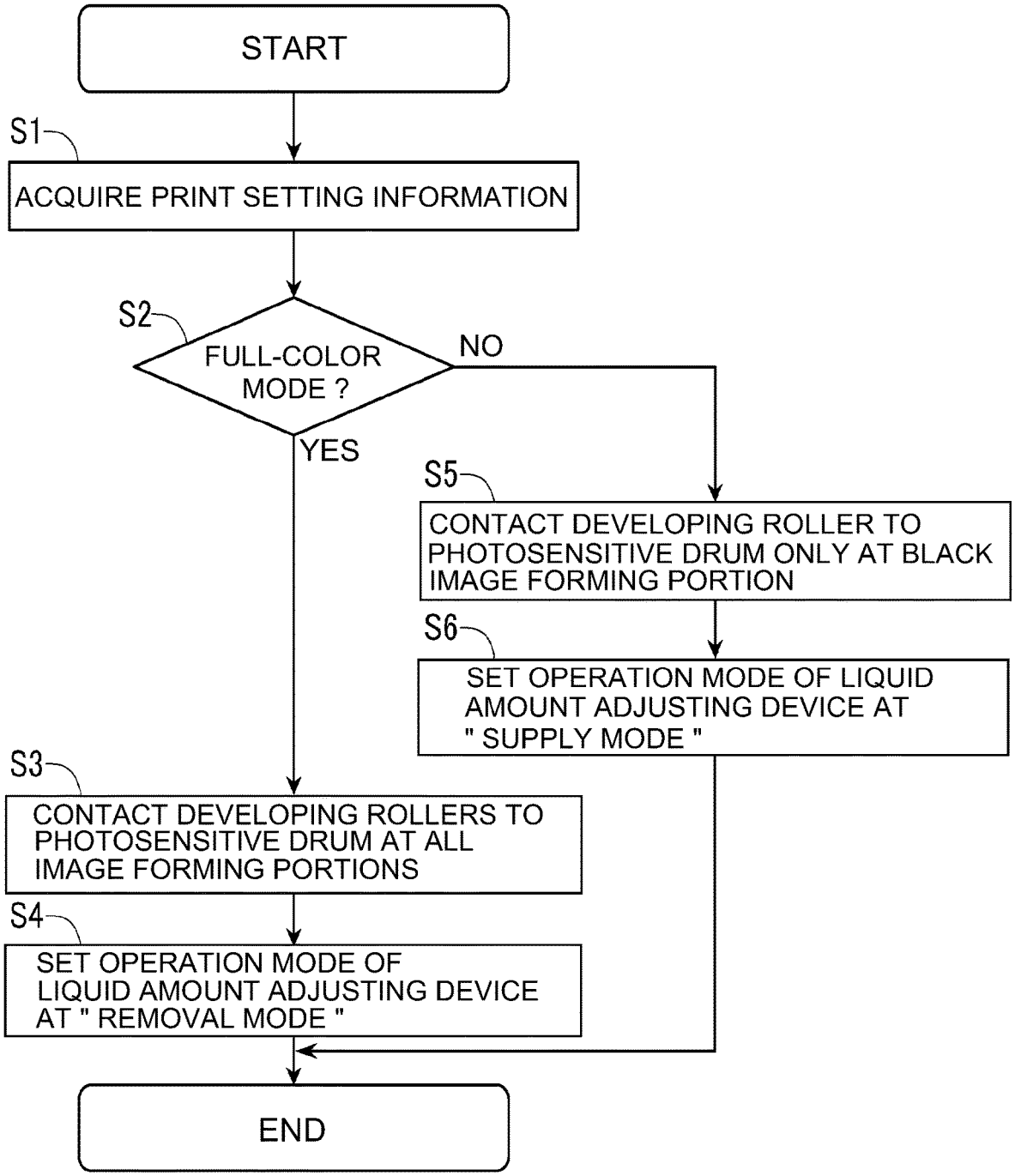
FIG. 6 is a flowchart showing liquid amount adjusting control.

In the following, the liquid amount adjusting control in this embodiment will be specifically described using FIG. 6 to part (b) of FIG. 7 while making reference to FIGS. 1 to 3. The liquid amount adjusting control in this embodiment is shown in FIG. 6. The controller 200 starts the liquid amount adjusting control shown in FIG. 6 with execution of the image forming job.

As shown in FIG. 6, the controller 200 acquires the print setting information from the received print signal (S1). The controller 200 discriminates whether or not the designation of the acquired print setting information is a "full-color mode" (S2). In the case of the "full-color mode" (YES of S2), the controller 200 brings the developing roller 41 into contact with the photosensitive drum 1 in all the image forming portions PY to PBk (S3). Then, the controller 200 sets the operation mode of the liquid amount adjusting device 170 at the above-described "removal mode" (see FIG. 4) (S4). The controller 200 starts the image forming operation after setting the operation mode of the liquid amount adjusting device 170 at the "removal mode".

On the other hand, in the case where the designation of the image forming mode is a "monochromatic mode", not the "full-color mode" (NO of S2), the controller 200 brings the developing roller 41 into contact with the photosensitive drum 1 only in the image forming portion PBk for black (S5). Then, the controller 200 sets the operation mode of the liquid amount adjusting device 170 at the above-described "supply mode" (see FIG. 3) (S6). The controller 200 starts the image forming operation after setting the operation mode of the liquid amount adjusting device 170 at the "supply mode".

Figure 7:
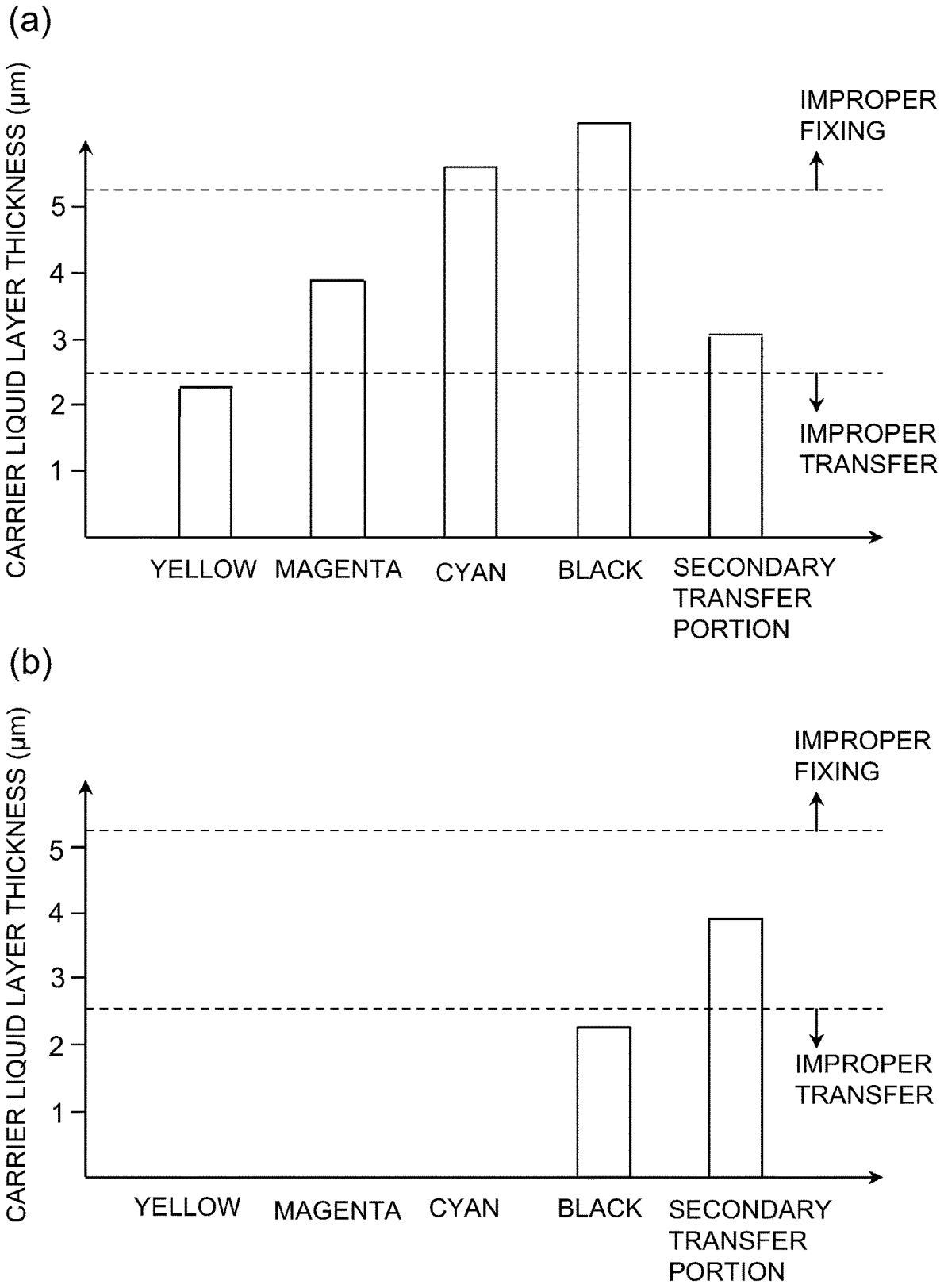
FIG. 7 includes views for illustrating a liquid amount of a carrier liquid layer, in which part (a) shows during full-color mode, and part (b) shows during monochromatic mode.

A change in liquid amount of the carrier liquid layer during full-color mode is shown in part (a) of FIG. 7. In part (a) of FIG. 7, thicknesses of the carrier liquid layer at the times when the carrier liquid layer passes through the respective primary transfer portions T1Y to T1Bk for yellow, magenta, cyan and black and when the carrier liquid layer reaches the secondary transfer portion T2 are shown. In the respective image forming portions PY to PBk, when the developing roller 41 is contacted to the photosensitive drum 1Y, the carrier liquid is supplied to the photosensitive drums 1Y to 1Bk. The carrier liquid supplied to the photosensitive drums 1Y and 1Bk is divided to the belt side at the primary transfer portions T1Y to T1Bk as described above, and is supplied to the belt 91. For that reason, the liquid amount of the carrier liquid layer formed on the belt 91 gradually increases as the carrier liquid layer moves toward the downstream side of the movement direction, with the result that as shown in part (a) of FIG. 7, a carrier liquid layer thickness becomes a maximum at the time when the carrier liquid layer passed through the primary transfer portion T1Bk. Thus, in the case of the full-color mode, excessive carrier (excess of the carrier) of the carrier liquid layer is liable to occur.

As described above, in this embodiment, in order to eliminate the excessive carrier, the controller 200 sets the operation mode of the liquid amount adjusting device 170 at the "removal mode", and causes the liquid amount adjusting device 170 to remove the carrier liquid in a predetermined amount from the carrier liquid layer. By doing so, as shown in part (a) of FIG. 7, the liquid amount of the carrier liquid layer at the time when the carrier liquid layer reaches the secondary transfer portion is suppressed to a proper amount, so that improper fixing in the fixing device 13 due to the excessive carrier does not occur. Further, improper transfer at the secondary transfer portion due to the shortage of the carrier also does not occur.

A change in liquid amount of the carrier liquid layer during monochromatic mode is shown in part (b) of FIG. 7. Also in part (a) of FIG. 7, thicknesses of the carrier liquid layer at the times when the carrier liquid layer passes through the respective primary transfer portions T1Y to T1Bk and when the carrier liquid layer reaches the secondary transfer portion T2 are shown. However, as can be understood from comparison with part (a) of FIG. 7, the carrier liquid layer thicknesses at the primary transfer portions T1Y to T1C other than the transfer portion T1Bk for black are "0". This is because in the case of the monochromatic mode, the developing roller 41 is contacted to the photosensitive drum 1Y only in the image forming portion PBk for black and the developing rollers 41 are separated from the photosensitive drums 1Y to 1C in the image forming portions PY to PC. In this case, at the primary transfer portions T1Y to T1C other than the primary transfer portion T1Bk for black, the carrier liquid is not supplied from the photosensitive drums 1Y to 1C to the belt 91, but the carrier liquid is supplied from the photosensitive drum 1Bk to the belt 91 only at the primary transfer portion T1Bk for black. Therefore, the carrier liquid layer is formed only at the time when the carrier liquid layer passed through the primary transfer portion T1Bk for black, so that the carrier liquid layer thickness at the primary transfer portions T1Y to T1C other than the primary transfer portion T1Bk for black become "0". Incidentally, the liquid amount of the carrier liquid layer formed during monochromatic mode is substantially equal to the liquid amount of the carrier liquid layer at the time when the carrier liquid layer passed through the primary transfer portion T1Y during full-color mode.

In the case of the monochromatic mode, the carrier liquid layer is formed only at the time when the carrier liquid layer passed through the primary transfer portion T1Bk, so that the liquid amount of the carrier liquid layer is liable to cause the shortage of the carrier in which the liquid amount of the carrier liquid layer is less than a proper amount. In order to eliminate this shortage of the carrier, the controller 200 sets the operation mode of the liquid amount adjusting device 170 at the "supply mode", and causes the liquid amount adjusting device 170 to supply the carrier liquid to the belt 91. By doing so, the liquid amount of the carrier liquid layer at the time when the carrier liquid layer reaches the secondary transfer portion T2 is increased to the proper amount, so that improper transfer at the secondary transfer portion T2 due to the shortage of the carrier does not occur. Further, improper fixing in the fixing device 13 due to the excessive carrier also does not occur.

As described above, in this embodiment, depending on the image forming mode, the operation mode of the liquid amount adjusting device 170 is set. The operation mode of the liquid amount adjusting device 170 is set at the supply mode (see FIG. 3) during monochromatic mode, and the liquid amount adjusting device 70 supplies the carrier liquid to the belt 91. That is, during monochromatic mode in which the shortage of the carrier of the carrier liquid layer is relatively liable to occur, the carrier liquid is supplied to the carrier liquid layer, so that the shortage of the carrier can be eliminated. On the other hand, the operation mode of the liquid amount adjusting device 170 is set at the removal mode (see FIG. 4) during full-color mode, and the liquid amount adjusting device 170 removes the carrier liquid from the belt 91. That is, during full-color mode in which the excessive carrier of the carrier liquid layer is relatively liable to occur, the carrier liquid is separated from the carrier liquid layer, so that the excessive carrier can be eliminated. Thus, the liquid amount adjustment of the carrier liquid layer depending on the image forming mode is carried out, whereby the occurrence of the improper transfer due to the shortage of the carrier during monochromatic mode and the occurrence of the improper fixing due to the excessive carrier during full-color mode are suppressed.

<Other Embodiments>

Incidentally, in the above-described embodiment, the operation mode of the liquid amount adjusting device 170 is set at the removal mode during full-color mode and is set at the supply mode during monochromatic mode, but a combination of the operation modes of the liquid amount adjusting device 170 depending on the image forming mode is not limited thereto. For example, combinations of the operation modes as shown in Table 1 below may also be used. In Table 1, "Supply" represents the supply mode, "Removal" represents the removal mode, and "Normal" represents a normal mode.

TABLE 1

| Image forming mode | Operation mode | | |
|---|---|---|---|
| Full-color mode | Removal | Removal | Normal |
| Monochromatic mode | Supply | Normal | Supply |

Figure 8:
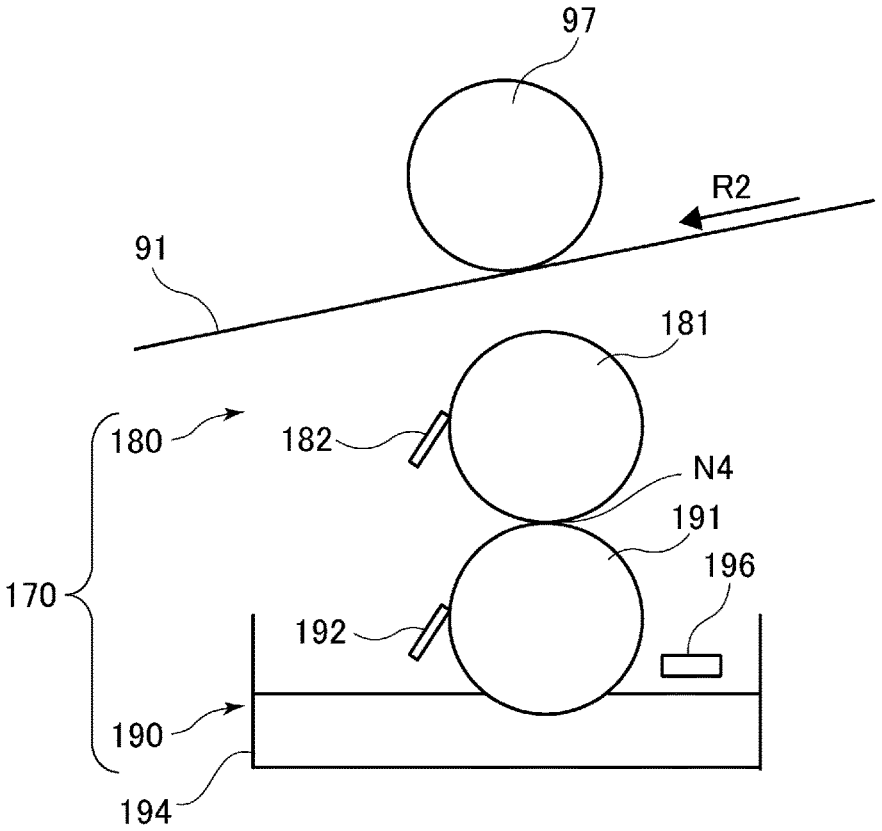
FIG. 8 is a schematic view for illustrating a normal mode of the liquid amount adjusting device.

The normal mode which is one of the operation modes is shown in FIG. 8. As shown in FIG. 8, in the case where the operation mode of the liquid amount adjusting device 170 is the normal mode, the supplying roller 191 forms the nip N4 in contact with the feeding roller 181, while the feeding roller 181 does not contact the belt 91 and does not form the nip N5 (see FIG. 3). That is, the belt 91 and the liquid amount adjusting device 170 are separated from each other. For that reason, even when the carrier liquid is drawn up from the carrier liquid tank 194 by the supplying roller 191 and is supplied to the feeding roller 181, the carrier liquid is not supplied to the belt 91. Further, the carrier liquid of the carrier liquid layer formed on the belt 91 is also not removed from the belt 91.

As shown in Table 1, the operation mode of the liquid amount adjusting device 170 may also be set at the removal mode during full-color mode and is set at the normal mode during monochromatic mode. This combination of the operation modes is effective in the case where penetration of the carrier liquid into the recording material S is slight as when the recording material S is a plastic film, coated paper or the like. That is, in the case where the penetration of the carrier liquid into the recording material S is slight, when the liquid amount of the carrier liquid layer formed on the belt 91 is large, the improper fixing due to the excessive carrier is liable to occur. Therefore, during full-color mode in which the liquid amount of the carrier liquid layer is relatively large, the carrier liquid is removed from the belt 91 by the liquid amount adjusting device 170. On the other hand, during monochromatic mode in which the liquid amount of the carrier liquid layer is relatively small, even when the carrier liquid is not supplied to the belt 91, the penetration of the carrier liquid into the recording material S is slight, and therefore, the improper transfer due to the shortage of the carrier does not readily occur. Accordingly, the operation mode may only be required to be set at the normal mode during monochromatic mode.

Or, as shown in Table 1, the operation mode of the liquid amount adjusting device 170 may also be set at the normal mode during full-color mode and is set at the supply mode during monochromatic mode. This combination of the operation modes is effective in the case where penetration of the carrier liquid into the recording material S is large as when the recording material S is plain paper, recycled paper or the like. That is, in the case where the penetration of the carrier liquid into the recording material S is large, when the liquid amount of the carrier liquid layer formed on the belt 91 is small, the improper transfer due to the shortage of the carrier is liable to occur. Therefore, during monochromatic mode in which the liquid amount of the carrier liquid layer is relatively small, the carrier liquid is supplied to the belt 91 by the liquid amount adjusting device 170. On the other hand, during full-color mode in which the liquid amount of the carrier liquid layer is relatively large, even when the carrier liquid is not removed from the belt 91, the penetration of the carrier liquid into the recording material S is large, and therefore, the improper fixing due to the excessive carrier does not readily occur. Accordingly, the operation mode may only be required to be set at the normal mode during full-color mode.

Figure 9:
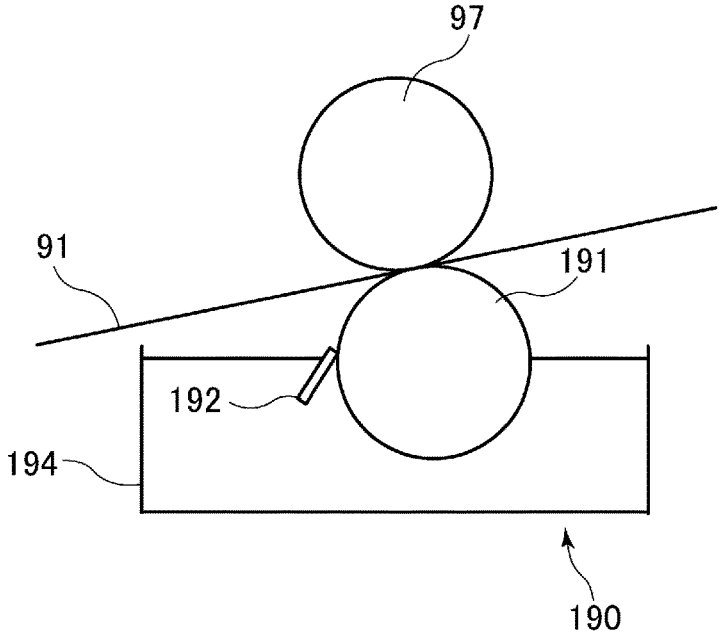
FIG. 9 is a schematic view showing another embodiment of the liquid amount adjusting device.

Incidentally, in the above-described embodiment, the liquid amount adjusting device 170 including the feeding device 180 and the supplying device 190 was described, but the liquid amount adjusting device 170 is not limited thereto. For example, as shown in FIG. 9, the liquid amount of the carrier liquid layer may also be made adjustable by using only the supplying device 180 without using the feeding device 190 (see FIG. 3). In this case, the supplying roller 191 is contacted to the belt 91 without interposing the feeding roller 181 (see FIG. 3) therebetween, so that the carrier liquid in the carrier liquid tank 194 can be directly from the supplying roller 191 to the belt 91. Then, the carrier liquid tank 194 is moved to a position where the carrier liquid tank 194 does not contact the supplying roller 191, so that the carrier liquid can be removed from the belt 91 by the supplying roller 191.

Incidentally, in the case of this embodiment, the feeding roller 181 and the supplying roller 191 are rotated while providing a difference in peripheral speed between the feeding roller 181 and the supplying roller 191. A supply amount of the carrier liquid supplied to the belt 91 may also be made adjustable. For example, in the case where the supply amount of the carrier liquid is increased, the supplying roller 191 may only be required to be rotated faster than the feeding roller rotated at the same speed as the belt 91 is. However, the feeding roller 181 and the supplying roller 191 may preferably be rotated with the speed difference within 5%.

In this embodiment, the amount of the carrier supplied to the belt is adjusted by rotating the feeding roller 181 at the same speed as the belt and by changing the rotational speed of the supplying roller 191. By doing so, the carrier supply amount can be changed without changing the speed between the feeding roller 181 and the belt, and leads to an improvement in image quality.

Incidentally, in the above-described embodiment, the liquid developer was prevented from being supplied from the photosensitive drums other than the photosensitive drum for black to the belt 91 by separating the developing device 4 from the photosensitive drum 1 during monochromatic mode, but the present invention is not limited thereto. For example, the photosensitive drums 1 other than the photosensitive drum 1 for black are provided so as to be contactable to and separable from the belt 91, and the photosensitive drums 1 may also be contacted to the belt 91 during full-color mode and may also be separated from the belt 91 during monochromatic mode.

Incidentally, in the above-described embodiment, a constitution in which the intermediary transfer belt was used as the intermediary transfer member was described, but the intermediary transfer member may also be, for example, an intermediary transfer drum formed in a drum shape. According to the present invention, the liquid amount of the carrier liquid on the intermediary transfer member is adjustable by supplying the carrier liquid to the intermediary transfer member during the second mode, so that the shortage of the carrier which has been liable to occur particularly during the second mode and in which the liquid amount of the carrier liquid on the intermediary transfer member is smaller than the proper amount can be eliminated.

INDUSTRIAL APPLICABILITY

According to the present invention, there is provided an image forming apparatus of an electrophotographic type in which an image is formed with the liquid developer.

The invention claimed is:

1. An image forming apparatus comprising:

a first image bearing member;

a second image bearing member;

a first developing device for developing a latent image, formed on said first image bearing member, with a developer containing toner and a carrier liquid;

a second developing device for developing a latent image, formed on said second image bearing member, with a developer containing toner and a carrier liquid;

an intermediary transfer member which is provided rotatably and onto which toner images are primary-transferred together with the carrier liquids from said first image bearing member and said second image bearing member;

a secondary transfer device for secondary-transferring the toner images, primary-transferred on said intermediary transfer member, onto a recording material;

a controller capable of selectively executing a first mode in which the toner images are primary-transferred together with the carrier liquids from said first image bearing member and said second image bearing member onto said intermediary transfer member, and a second mode in which the toner image is primary-transferred together with the carrier liquid from said second image bearing member onto said intermediary transfer member with control of said first developing device so as to prevent the carrier liquid from being supplied from said first developing device to said first image bearing member; and a supplying device provided opposed to said intermediary transfer member on a side downstream of said second image bearing member and upstream of said secondary transfer device with respect to a rotational direction of said intermediary transfer member, and capable of supplying a carrier liquid to said intermediary transfer member at least during execution of said second mode.

2. An image forming apparatus according to claim 1, wherein said supplying device is constituted so as to be capable of collecting the carrier liquid from said intermediary transfer member, and said controller is capable of selectively executing a collecting mode in which the carrier liquid is collected from said intermediary transfer member by said supplying device and a supplying mode in which the carrier liquid is supplied to said intermediary transfer member by said supplying device.

3. An image forming apparatus according to claim 2, wherein said supplying device includes a carrier liquid tank for accommodating the carrier liquid and a first roller contacting said intermediary transfer member and capable of carrying the carrier liquid accommodated in said carrier liquid tank, and wherein said controller causes said supplying device to supply the carrier liquid to said intermediary transfer member by carrying the carrier liquid in said carrier liquid tank on said first roller during said second mode and causes said supplying device to remove the carrier liquid from said intermediary transfer member by said first roller by preventing the carrier liquid in said carrier liquid tank from being carried on said first roller during said first mode.

4. An image forming apparatus according to claim 3, wherein said supplying device includes a second roller provided so as to be contactable to and separable from said first roller and capable of supplying the carrier liquid in said carrier liquid tank to said first roller, and wherein said controller causes said supplying device to supply the carrier liquid in said carrier liquid tank from said second roller to said first roller by causing said second roller to contact said first roller during said second mode and causes said supplying device to prevent supply of the carrier liquid in said carrier liquid tank to said first roller by causing said second roller to be separated from said first roller during said first mode.

5. An image forming apparatus according to claim 3, wherein said first roller is provided with voltage applying means for applying a voltage, to said first roller, of a polarity identical to a polarity of the toner.

* * * * *